US010396479B2

(12) United States Patent
Hoshiba et al.

(10) Patent No.: US 10,396,479 B2
(45) Date of Patent: Aug. 27, 2019

(54) MULTIPOLAR CONNECTOR SET

(71) Applicant: Murata Manufacturing Co., Ltd., Kyoto-fu (JP)

(72) Inventors: Hiroyuki Hoshiba, Nagaokakyo (JP); Minoru Ikeda, Nagaokakyo (JP); Yuma Amemori, Nagaokakyo (JP); Yukihiro Kitaichi, Nagaokakyo (JP); Minoru Mamuro, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 8 days.

(21) Appl. No.: 15/873,309

(22) Filed: Jan. 17, 2018

(65) Prior Publication Data

US 2018/0205165 A1 Jul. 19, 2018

(30) Foreign Application Priority Data

Jan. 19, 2017 (JP) ..... 2017-007793
Oct. 20, 2017 (JP) ..... 2017-203729

(51) Int. Cl.
*H01R 12/71* (2011.01)
*H01R 13/646* (2011.01)
(Continued)

(52) U.S. Cl.
CPC ..... *H01R 12/716* (2013.01); *H01R 13/646* (2013.01); *H01R 12/79* (2013.01); *H01R 13/6583* (2013.01); *H01R 13/6586* (2013.01)

(58) Field of Classification Search
CPC ..... H01R 12/52; H01R 9/096
(Continued)

(56) References Cited

U.S. PATENT DOCUMENTS 4,616,893 A * 10/1986 Feldman ..... H01R 12/7088 439/108
4,762,500 A * 8/1988 Dola ..... H01R 13/6585 439/79
(Continued)

FOREIGN PATENT DOCUMENTS

CN 2360979 Y 1/2000
CN 205882212 U 1/2017
(Continued)

OTHER PUBLICATIONS

An Office Action mailed by the Chinese Patent Office dated Apr. 3, 2019, which corresponds to Chinese Patent Application No. 201810043901. 7 and is related to U.S. Appl. No. 15/873,309 with English language translation.

*Primary Examiner* — Tulsidas C Patel
*Assistant Examiner* — Marcus E Harcum
(74) *Attorney, Agent, or Firm* — Studebaker & Brackett PC

(57) ABSTRACT

A multipolar connector set includes a first connector and a second connector fitted together. The first connector includes first inner terminals arranged in multiple rows and a first insulating member configured to hold the first inner terminals, and the second connector includes second inner terminals arranged in multiple rows and a second insulating member configured to hold the second inner terminals. The multipolar connector set further includes a conductive shielding member disposed between adjacent rows of the first or second inner terminals in a fitted state where the first connector and the second connector are fitted together, with the first inner terminals being in contact the second inner terminals.

3 Claims, 17 Drawing Sheets

(51) Int. Cl.
*H01R 13/6583* (2011.01)
*H01R 12/79* (2011.01)
*H01R 13/6586* (2011.01)

(58) Field of Classification Search
USPC ..... 439/74, 66, 607.08, 607.09
See application file for complete search history.

(56) References Cited

U.S. PATENT DOCUMENTS 5,120,232 A * 6/1992 Korsunsky ..... H01R 23/6873 439/108
5,183,405 A * 2/1993 Elicker ..... H01R 12/714 439/108
5,413,491 A * 5/1995 Noschese ..... H01R 23/688 439/108
5,813,871 A * 9/1998 Grabbe ..... H01R 23/688 439/108
6,077,121 A * 6/2000 Wu ..... H01R 12/712 439/607.05
6,089,883 A * 7/2000 McHugh ..... H01R 23/6873 439/108
6,250,935 B1 * 6/2001 Mochizuki ..... H01R 13/658 439/74
6,764,315 B2 * 7/2004 Ng ..... H01R 12/714 439/66
6,984,137 B2 * 1/2006 Akasaka ..... H01R 13/6585 439/108
7,144,277 B2 * 12/2006 Pan ..... H01R 12/716 439/660
9,246,279 B2 * 1/2016 Kato ..... H01R 13/6596
2005/0032400 A1 * 2/2005 Zhang ..... H01R 13/41 439/74
2005/0037642 A1 * 2/2005 Zhang ..... H01R 43/0256 439/74
2006/0089018 A1 * 4/2006 Orita ..... H01R 12/57 439/74
2015/0270633 A1 * 9/2015 Kodaira ..... H01R 12/79 439/357
2015/0357735 A1 * 12/2015 Uratani ..... H01R 12/716 439/660

FOREIGN PATENT DOCUMENTS

JP 2012-018781 A 1/2012
TW 374508 U 11/1999

* cited by examiner

MULTIPOLAR CONNECTOR SET

CROSS-REFERENCE TO RELATED APPLICATIONS

This application claims benefit of priority to Japanese Patent Application No. 2017-203729, filed Oct. 20, 2017 and Japanese Patent Application No. 2017-007793, filed Jan. 19, 2017, the entire contents of both are incorporated herein by reference.

BACKGROUND

Technical Field

The present disclosure relates to a multipolar connector set formed by fitting a first connector and a second connector together.

Description of the Related Art

Connector sets for electrically connecting about two circuit boards have been known. For example, a connector set disclosed in Japanese Unexamined Patent Application Publication No. 2012-18781 is formed by connecting one of two circuit boards to a first connector and connecting the other circuit board to a second connector, and fitting the first connector and the second connector together.

In the connector set disclosed in Japanese Unexamined Patent Application Publication No. 2012-18781, each of the connectors includes multiple rows of terminals. Multipolar connectors for use at high frequencies require more poles because of a widening range of signal applications and an increasing circuit density. In this case, simply arranging a plurality of terminals in a single row leads to an increased size in the longitudinal direction. To avoid this, the terminals may be arranged in multiple rows as in Japanese Unexamined Patent Application Publication No. 2012-18781.

However, when the terminals are arranged in multiple rows, signal interference may occur between adjacent rows of terminals.

An object of the present disclosure is to solve the problem described above and provide a connector set capable of suppressing interference between adjacent rows of terminals.

SUMMARY

To achieve the object described above, preferred embodiments of the present disclosure provide a multipolar connector set that includes a first connector and a second connector fitted together. The first connector includes first inner terminals arranged in multiple rows and a first insulating member configured to hold the first inner terminals, and the second connector includes second inner terminals arranged in multiple rows and a second insulating member configured to hold the second inner terminals. The multipolar connector set further includes a conductive shielding member disposed between adjacent rows of the first or second inner terminals in a fitted state where the first connector and the second connector are fitted together, with the first inner terminals being in contact with the second inner terminals.

The multipolar connector set according to the preferred embodiments of the present disclosure is capable of suppressing interference between adjacent rows of inner terminals.

Other features, elements, characteristics and advantages of the present disclosure will become more apparent from the following detailed description of preferred embodiments of the present disclosure with reference to the attached drawings.

DETAILED DESCRIPTION

Figure 1A:
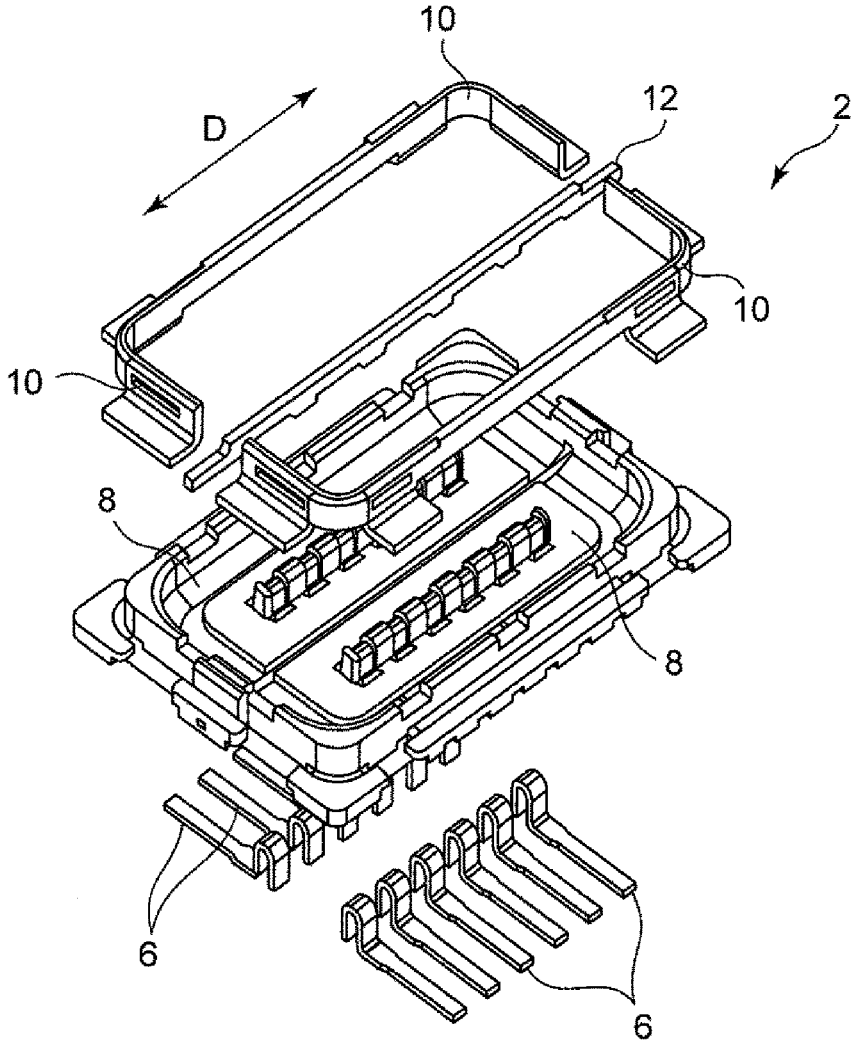
FIG. 1A is an exploded perspective view of a first connector according to a first embodiment.

A first aspect of the present disclosure provides a multipolar connector set that includes a first connector and a second connector fitted together. The first connector includes first inner terminals arranged in multiple rows and a first insulating member configured to hold the first inner terminals, and the second connector includes second inner terminals arranged in multiple rows and a second insulating member configured to hold the second inner terminals. The multipolar connector set further includes a conductive shielding member disposed between adjacent rows of the first or second inner terminals in a fitted state where the first connector and the second connector are fitted together, with the first inner terminals being in contact with the second inner terminals. This configuration suppresses electromagnetic wave interference between adjacent rows of inner terminals. The multipolar connector set thus improves its performance as a connector, particularly when used at high frequencies.

A second aspect of the present disclosure provides the multipolar connector set of the first aspect, wherein at least one of the first connector and the second connector may further include an outer terminal connected to a ground potential and held by a corresponding one of the first insulating member and the second insulating member, and the shielding member may be electrically connected to the outer terminal. This configuration suppresses electromagnetic wave interference from outside the connector, and suppresses electromagnetic wave interference between adjacent rows of inner terminals.

A third aspect of the present disclosure provides the multipolar connector set of the first or second aspect, wherein the shielding member may include a first shielding member held by the first insulating member of the first connector, and a second shielding member held by the second insulating member of the second connector. This configuration facilitates handling of the connectors.

A fourth aspect of the present disclosure provides the multipolar connector set of the third aspect, wherein the first shielding member and the second shielding member may be in contact with each other in the fitted state. This configuration further suppresses electromagnetic wave interference between adjacent rows of inner terminals.

A fifth aspect of the present disclosure provides the multipolar connector set of the fourth aspect, wherein the first shielding member and the second shielding member may be in contact with each other at recessed and raised portions thereof that are fitted together, and the recessed and raised portions may be at least partly made of an elastically deformable material. This configuration improves contact between the first shielding member and the second shielding member, and enhances a fit retaining force.

A sixth aspect of the present disclosure provides the multipolar connector set of the fifth aspect, wherein about two first shielding members may be provided to face each other along a direction in which the rows of the first and second inner terminals extend, and the second shielding member may be an integral member configured to hold the about two first shielding members. This configuration makes the first connector and the second connector less susceptible to disconnection.

A seventh aspect of the present disclosure provides the multipolar connector set of the first aspect. In this configuration, the first connector may include a first outer terminal connected to a ground potential and held by the first insulating member, and the second connector may include a second outer terminal connected to the ground potential and held by the second insulating member. Also, the shielding member may include a first shielding member held by the first insulating member and disposed between adjacent rows of the first inner terminals of the first connector, and a second shielding member held by the second insulating member and disposed between adjacent rows of the second inner terminals of the second connector. With this configuration, where the first connector and the second connector each include an outer terminal and a shielding member, the degree of design freedom is improved.

An eighth aspect of the present disclosure provides the multipolar connector set of the seventh aspect, wherein in the fitted state, the first shielding member of the first connector may be in contact with the second outer terminal of the second connector, or the second shielding member of the second connector may be in contact with the first outer terminal of the first connector. This configuration further suppresses electromagnetic wave interference between adjacent rows of inner terminals.

A ninth aspect of the present disclosure provides the multipolar connector set of the seventh or eighth aspect. In this configuration, the first outer terminal of the first connector may be formed in a substantially annular shape to surround at least part of the first inner terminals and the first shielding member of the first connector, or the second outer terminal of the second connector may be formed in a substantially annular shape to surround at least part of the second inner terminals and the second shielding member of the second connector. With this configuration, where either the first or second outer terminal is formed in a substantially annular shape, a shielding effect against external noise or radiation noise is improved.

A tenth aspect of the present disclosure provides the multipolar connector set of any one of the seventh to ninth aspects. In this configuration, the first shielding member may have a recess on a side opposite a side facing the second connector, and the recess can be filled with the first insulating member and configured to allow the first insulating member to be caught in the first shielding member, or the second shielding member may have a recess on a side opposite a side facing the first connector, and the recess can be filled with the second insulating member and configured to allow the second insulating member to be caught in the second shielding member. This configuration prevents the first or second shielding member from falling off.

An eleventh aspect of the present disclosure provides the multipolar connector set of any one of the seventh to tenth aspects. In this configuration, the second outer terminal may have a protrusion and the first outer terminal may have a recess configured to accommodate the protrusion. In the fitted state, the first outer terminal and the second outer terminal may be fitted together, with the protrusion of the second outer terminal being engaged in the recess of the first outer terminal in a direction intersecting a direction in which the first connector and the second connector face each other. This configuration makes the first connector and the second connector less susceptible to disconnection.

A twelfth aspect of the present disclosure provides the multipolar connector set of any one of the first to eleventh aspects. In this configuration, the first insulating member or the second insulating member may have a groove on a board mounting side thereof, with the groove being formed around a region where the shielding member is exposed. When the first connector or the second connector is soldered to a circuit board, this configuration prevents the inner terminals and the shielding member from being connected by the solder, and reduces entry of the solder into the interior of the connector.

Hereinafter, embodiments of the present disclosure will be described in detail on the basis of the drawings.

First Embodiment (General Configuration)

Figure 1B:
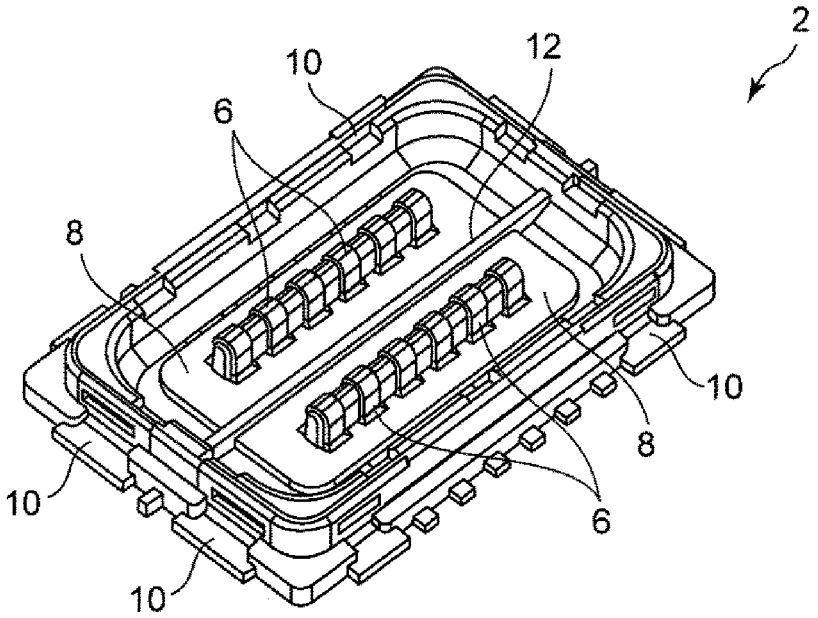
FIG. 1B is a perspective view of the first connector according to the first embodiment in an assembled state.
Figure 2A:
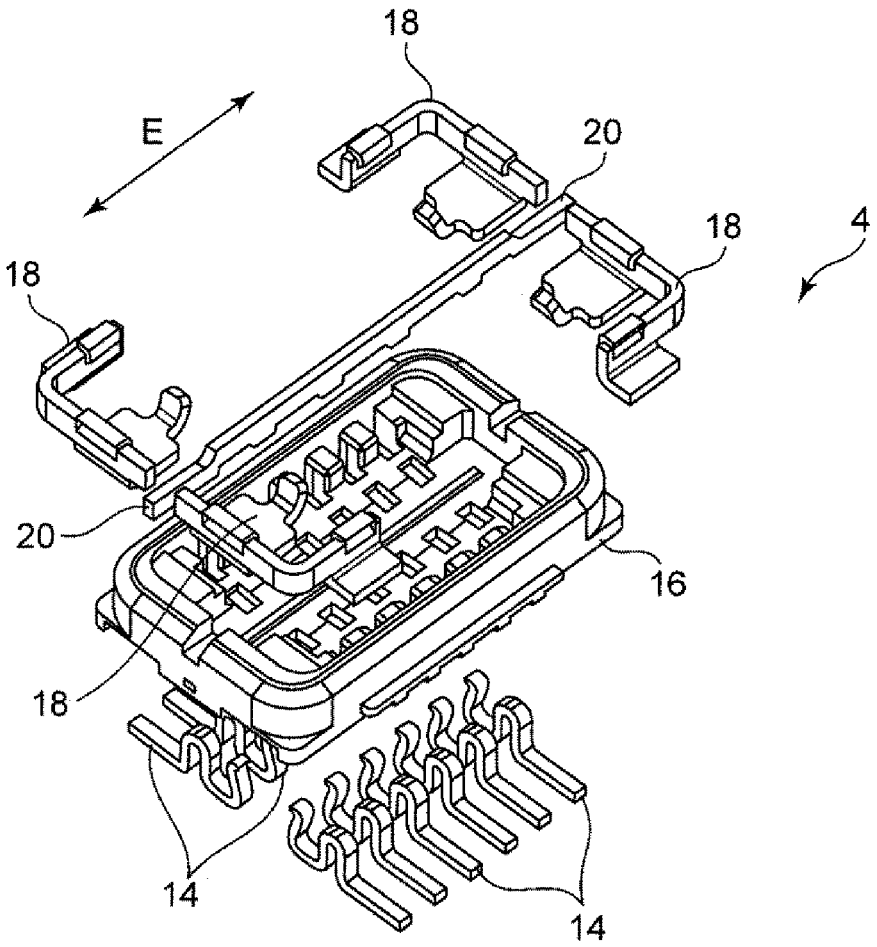
FIG. 2A is an exploded perspective view of a second connector according to the first embodiment.
Figure 2B:
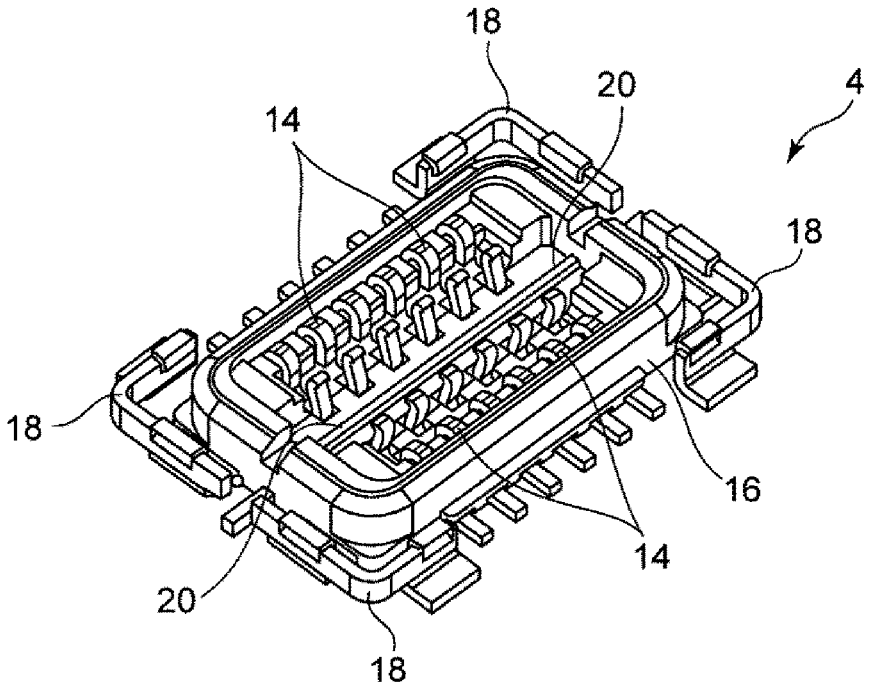
FIG. 2B is a perspective view of the second connector according to the first embodiment in an assembled state.
Figure 3:
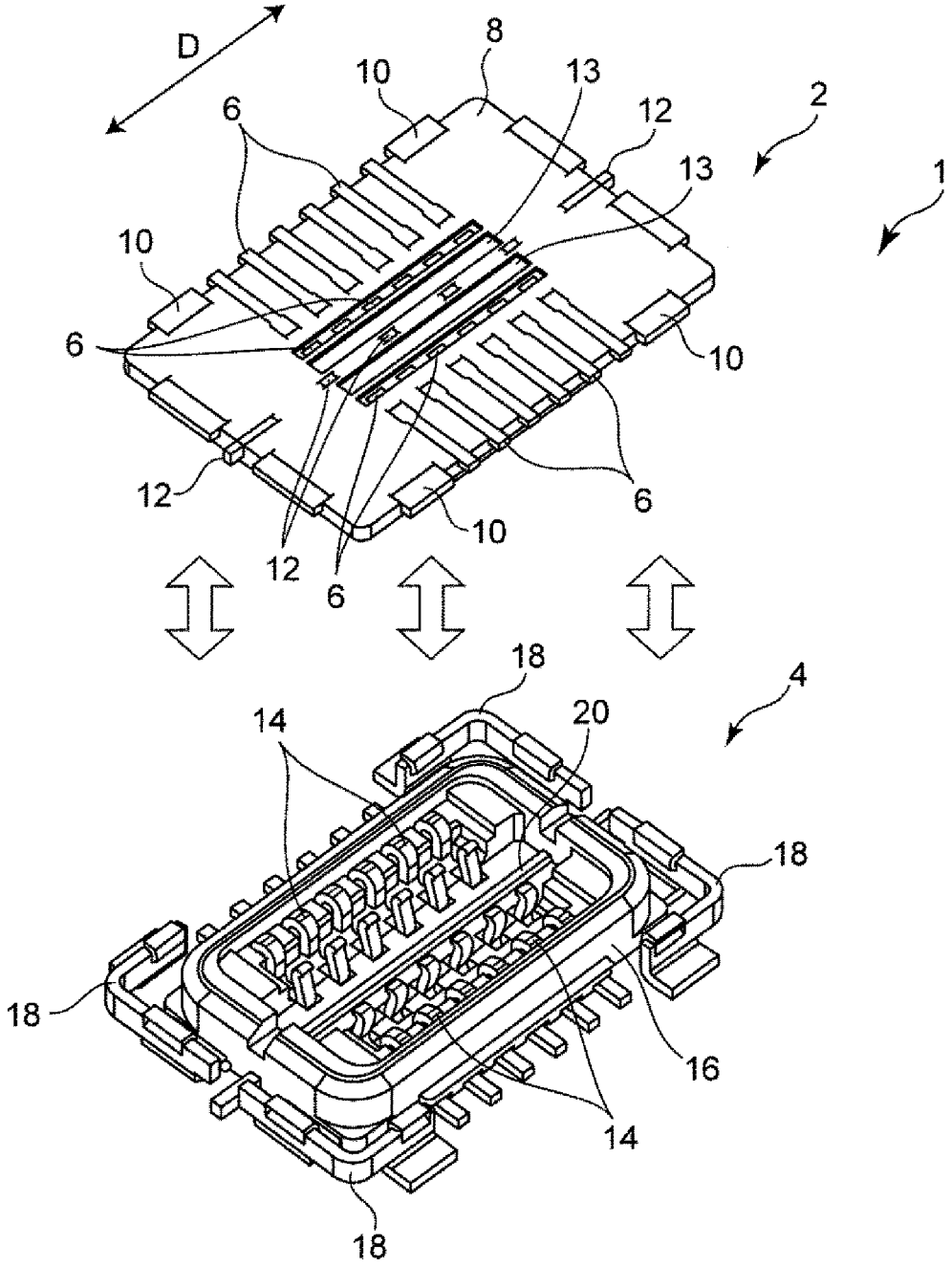
FIG. 3 is a perspective view of a multipolar connector set according to the first embodiment in a pre-fitted state.

FIGS. 1A and 1B are perspective views illustrating a general configuration of a first connector 2 of a multipolar connector set according to a first embodiment. FIGS. 2A and 2B are perspective views illustrating a general configuration of a second connector 4 of the multipolar connector set according to the first embodiment. FIG. 3 is a perspective view illustrating how the first connector 2 and the second connector 4 are fitted together. Note that FIGS. 1A and 2A are exploded perspective views of connectors, and FIGS. 1B and 2B are perspective views of the connectors in an assembled state.

Figure 4:
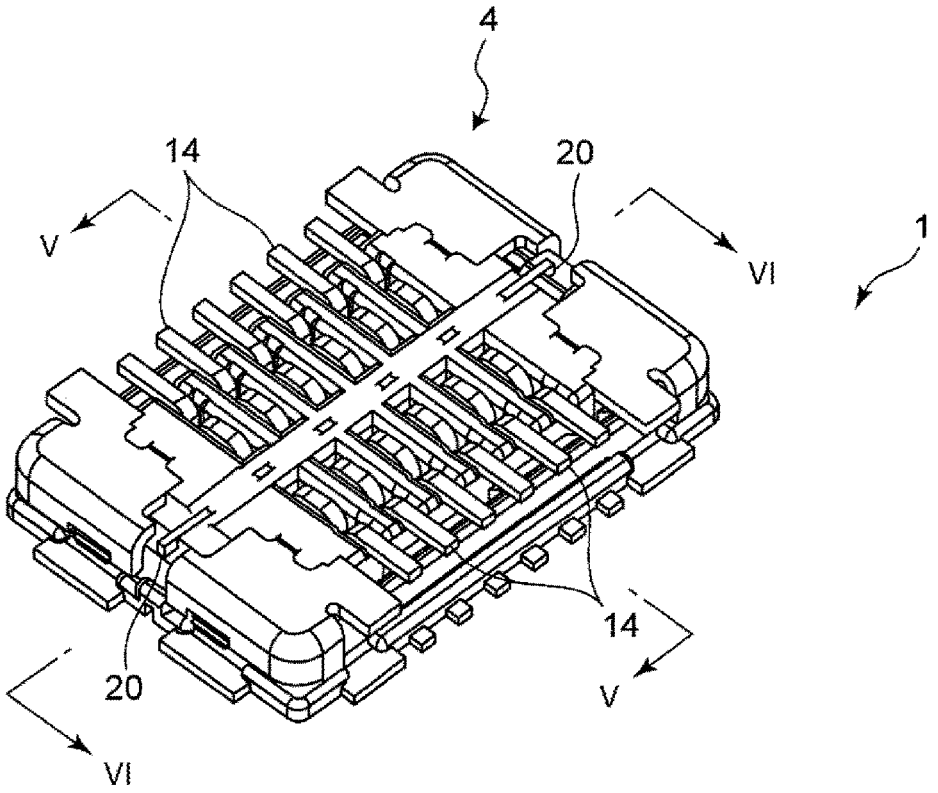
FIG. 4 is a perspective view of the multipolar connector set according to the first embodiment in a fitted state, as seen from a second connector side.

As illustrated in FIG. 3, the multipolar connector set according to the first embodiment is formed by fitting together the first connector 2 illustrated in FIG. 1B and the second connector 4 illustrated in FIG. 2B. Fitting the first connector 2 and the second connector 4 together, as illustrated in FIG. 3, produces a multipolar connector set 1 illustrated in FIG. 4. FIG. 4 is a perspective view of the multipolar connector set 1, as seen from a back side of the second connector 4.

The first connector 2 and the second connector 4 are connected to different circuit boards (not shown). These circuit boards are electrically connected by the multipolar connector set 1 that includes the first connector 2 and the second connector 4.

The first connector 2 and the second connector 4 will now be described.

(First Connector 2)

As illustrated in FIGS. 1A and 1B, the first connector 2 includes a plurality of inner terminals (first inner terminals) 6, an insulating member (first insulating member) 8, an outer terminal (first outer terminal) 10, and a shielding member (first shielding member) 12. The inner terminals 6 are conductors connected to a signal potential or ground potential. The inner terminals 6 are formed by bending substantially bar-like conductive members. The inner terminals 6 are fitted and held in corresponding grooves of the insulating member 8. In the fitted state of the first connector 2 and the second connector 4 illustrated in FIG. 4, the inner terminals 6 are in contact with respective inner terminals 14 (described below) of the second connector 4. This contact between the inner terminals 6 and the inner terminals 14 allows the first connector 2 and the second connector 4 to be electrically connected.

The inner terminals 6 are arranged in multiple rows, each containing a plurality of inner terminals 6. In the example illustrated in FIGS. 1A and 1B, the inner terminals 6 are arranged in about two rows, each containing about six inner terminals 6. The inner terminals 6 in each row are arranged in a direction D.

The insulating member 8 is an insulating member that integrally holds the inner terminals 6 (described above) and the outer terminal 10 and the shielding member 12 (described below). The insulating member 8 is, for example, a resin member.

In the first embodiment, the first connector 2 is manufactured by insert-molding the inner terminals 6, the outer terminal 10, and the shielding member 12 into the insulating member 8. The outer terminal 10 is a conductor connected to the ground potential. By being connected to the ground potential to maintain the earth potential, the outer terminal 10 blocks radio waves from outside the first connector 2 and forms an electrically shielded space in the first connector 2. The outer terminal 10 is designed particularly to protect the inner terminals 6 from radio wave interference from outside the connector. The outer terminal 10 is fitted and held in a groove around the insulating member 8 in such a manner that it surrounds the inner terminals 6.

The shielding member 12 is a conductive member for suppressing electromagnetic wave interference between the rows of the inner terminals 6. As illustrated in FIG. 1B, the shielding member 12 is disposed between the rows of the inner terminals 6 and fitted and held in a groove of the insulating member 8.

The shielding member 12 is not directly in contact with the outer terminal 10, but is electrically connected to the outer terminal 10 on a circuit board (not shown) to which the first connector 2 is connected. By this connection, the shielding member 12 maintains an integral earth potential with the outer terminal 10. The shielding member 12 having the earth potential forms a shield against electromagnetic waves, and suppresses electromagnetic wave interference between the rows of the inner terminals 6.

In the first embodiment, the shielding member 12 is formed as a substantially plate-like member elongated in the direction D along which the inner terminals 6 in each row are arranged. With the outer terminal 10 and the shielding member 12 of the first connector 2, an interference between the rows of the inner terminals 6 is suppressed by the shielding member 12 while an interference from the outside is suppressed by the outer terminal 10. In the first embodiment, the inner terminals 6, the outer terminal 10, and the shielding member 12 described above are made of phosphor bronze, which is a conductive, elastically deformable material.

As illustrated in FIG. 3, the insulating member 8 of the first connector 2 has, on the back side thereof, about two grooves 13 extending in the direction D. On the back side of the insulating member 8, the grooves 13 are each disposed between a region where end portions of the inner terminals 6 are exposed and a region where the shielding member 12 is exposed. With the grooves 13, when the first connector 2 is soldered to the circuit board, the inner terminals 6 and the shielding member 12 are prevented from being connected by the solder, and entry of the solder into the interior of the connector is reduced. That is, the grooves 13 are "anti-solder grooves" that are formed, on the board mounting side of the insulating member 8, around the region where the shielding member 12 is exposed.

(Second Connector 4)

As illustrated in FIGS. 2A and 2B, the second connector 4 includes a plurality of inner terminals (second inner terminals) 14, an insulating member (second insulating member) 16, an outer terminal (second outer terminal) 18, and a shielding member (second shielding member) 20. Components of the second connector 4 are similar to those of the first connector 2, and thus will not be described in detail.

The inner terminals 14 are conductors that are in contact with the inner terminals 6 of the first connector 2 and are held by the insulating member 16. Like the inner terminals 6 described above, the inner terminals 14 are formed by bending substantially bar-like members.

The inner terminals 14 are arranged to correspond to the respective inner terminals 6 of the first connector 2. More specifically, the inner terminals 14 are also arranged in about two rows, each containing about six inner terminals 14. The inner terminals 14 are in contact with the inner terminals 6 on a one-to-one basis.

Like the insulating member 8 described above, the insulating member 16 is an insulating member that integrally holds the inner terminals 14, the outer terminal 18, and the shielding member 20. The insulating member 16 is a resin member in the first embodiment.

Like the outer terminal 10 described above, the outer terminal 18 is a conductor connected to the ground potential to protect the inner terminals 14 from interference from outside the connector. The outer terminal 18 is disposed to surround the inner terminals 14.

Like the shielding member 12 described above, the shielding member 20 is a conductive member for suppressing electromagnetic wave interference between the rows of the inner terminals 14. The shielding member 20 is formed as a substantially plate-like member elongated in a direction E in which the rows of the inner terminals 14 extend. The shielding member 20 is electrically connected to the outer terminal 18 on a circuit board (not shown) to which the second connector 4 is connected.

Like the first connector 2 described above, the second connector 4 includes the outer terminal 18 and the shielding member 20. Thus, an interference between the rows of the inner terminals 14 is suppressed by the shielding member 20 while an interference from the outside is suppressed by the outer terminal 18.

(Multipolar Connector Set 1)

The multipolar connector set 1 formed by fitting the first connector 2 and the second connector 4 together will now be described.

(Connection Between Inner Terminals 6 and 14)

Figure 5:
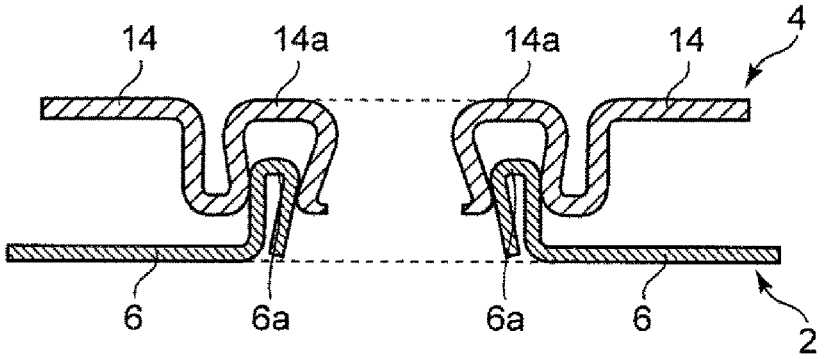
FIG. 5 illustrates part of a cross-section taken along line V-V of FIG. 4.

FIG. 5 illustrates how the inner terminals 6 of the first connector 2 and the inner terminals 14 of the second connector 4 are contacted and fitted together. FIG. 5 is a cross-sectional view of the multipolar connector set 1 taken along line V-V of FIG. 4. To simplify the explanation, only the inner terminals 6 and 14 are shown in FIG. 5.

As illustrated in FIG. 5, the inner terminals 6 of the first connector 2 each have, at an end thereof, a raised portion 6*a* protruding toward the inner terminals 14 of the second connector 4. On the other hand, the inner terminals 14 of the second connector 4 each have, at an end thereof, a recessed portion 14*a* recessed to accommodate the corresponding raised portion 6*a* of the inner terminal 6.

In the fitted state illustrated in FIG. 5, the raised portion 6*a* of each inner terminal 6 is inserted into and in contact with the corresponding recessed portion 14*a* of the inner terminal 14. As described above, the inner terminals 6 and 14 are both made of an elastically deformable material (phosphor bronze in the first embodiment). Therefore, inserting the raised portion 6*a* into the recessed portion 14*a* expands the recessed portion 14*a* outward. The recessed portion 14*a* made of an elastic material tries to return back to its original shape, and thus biases the raised portion 6*a* in an inwardly tightening direction. This biasing force allows the inner terminals 6 and the inner terminals 14 to be tightly fitted together.

(Relation Between Shielding Members 12 and 20)

Figure 6:
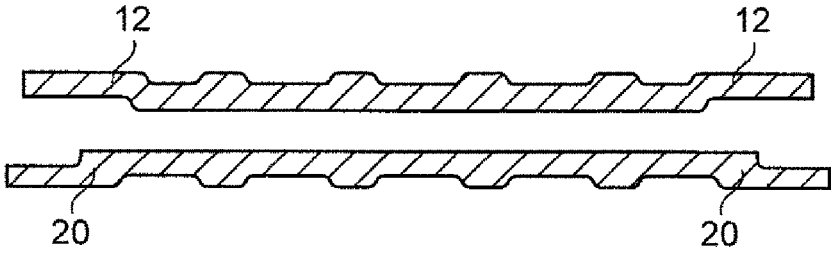
FIG. 6 illustrates part of a cross-section taken along line VI-VI of FIG. 4.

A relation between the shielding member 12 and the shielding member 20 is illustrated in FIG. 6. FIG. 6 is a cross-sectional view of the multipolar connector set 1 taken along line VI-VI of FIG. 4. To simplify the explanation, only the shielding member 12 and the shielding member 20 are shown in FIG. 6.

As illustrated in FIG. 6, the shielding member 12 and the shielding member 20 are spaced apart and extend substantially parallel to each other. Even when spaced apart, the shielding member 12 and the shielding member 20 can form an electromagnetic shield by being close to each other. It is thus possible to block electromagnetic coupling through the space between the shielding member 12 and the shielding member 20, and suppress electromagnetic wave interference between the rows of the inner terminals 6 and 14.

In the multipolar connector set 1, electromagnetic wave interference between the rows of the inner terminals 6 and 14 is more likely to occur, particularly when high-frequency signals are passed through the inner terminals 6 and 14. In the first embodiment, where an electromagnetic shield is formed by the conductive shielding members 12 and 20 between the rows of the inner terminals 6 and 14, electromagnetic wave interference between the rows of the inner terminals 6 and 14 is suppressed. The multipolar connector set 1 thus improves its signal transmission performance particularly when used at high frequencies, and improves its performance as a connector.

Also, in the first embodiment, two shielding members 12 and 20 are provided to suppress electromagnetic wave interference between the rows of the inner terminals 6 and 14. With this configuration, as compared to the case where a single integral shielding member is provided, the sizes of the individual shielding members 12 and 20 are smaller. This prevents the shielding member from being highest in size in the connector, and facilitates handling of the connector.

As described above, the multipolar connector set 1 of the first embodiment is a connector set formed by fitting the first connector 2 and the second connector 4 together. The first connector 2 includes the inner terminals 6 arranged in multiple rows, and the insulating member 8 configured to hold the inner terminals 6. The second connector 4 includes the inner terminals 14 arranged in multiple rows, and the insulating member 16 configured to hold the inner terminals 14. The first connector 2 and the second connector 4 include the conductive shielding members 12 and 20, respectively, which are located between the rows of the inner terminals 6 and 14 when the inner terminals 6 and 14 are in contact and fitted together.

This configuration, which includes the shielding members 12 and 20, suppresses electromagnetic wave interference between the rows of the inner terminals 6 and 14. Since this improves the signal transmission performance of the connectors 2 and 4, the multipolar connector set 1 improves its performance particularly when used at high frequencies.

In the multipolar connector set 1 of the first embodiment, the first connector 2 and the second connector 4 further include the outer terminals 10 and 18, respectively. The outer terminals 10 and 18 are connected to the ground potential, and held by the insulating members 8 and 16, respectively. The shielding members 12 and 20 are electrically connected to the outer terminals 10 and 18, respectively.

This configuration, which includes the outer terminals 10 and 18 connected to the ground potential, electrically shields the inner terminals 6 and 14 from outside the connectors. Additionally, since the shielding members 12 and 20 are electrically connected to the outer terminals 10 and 18, the shielding members 12 and 20 maintain an electrically integral earth potential together with the outer terminals 10 and 18, and further suppress electromagnetic wave interference between the rows of the inner terminals 6 and 14.

As described above, the multipolar connector set 1 of the first embodiment includes the shielding member 12 (first shielding member) and the shielding member 20 (second shielding member) for suppressing interference between the rows of the inner terminals 6 and 14. Thus, with the two shielding members 12 and 20, it is easier to handle the connectors 2 and 4 than with a single integral shielding member.

Second Embodiment

A multipolar connector set according to a second embodiment of the present disclosure will now be described. The second embodiment mainly describes differences from the first embodiment. In the second embodiment, components that are the same as or similar to those of the first embodiment are denoted by the same reference numerals. In the second embodiment, descriptions overlapping those in the first embodiment are omitted.

Figure 7:
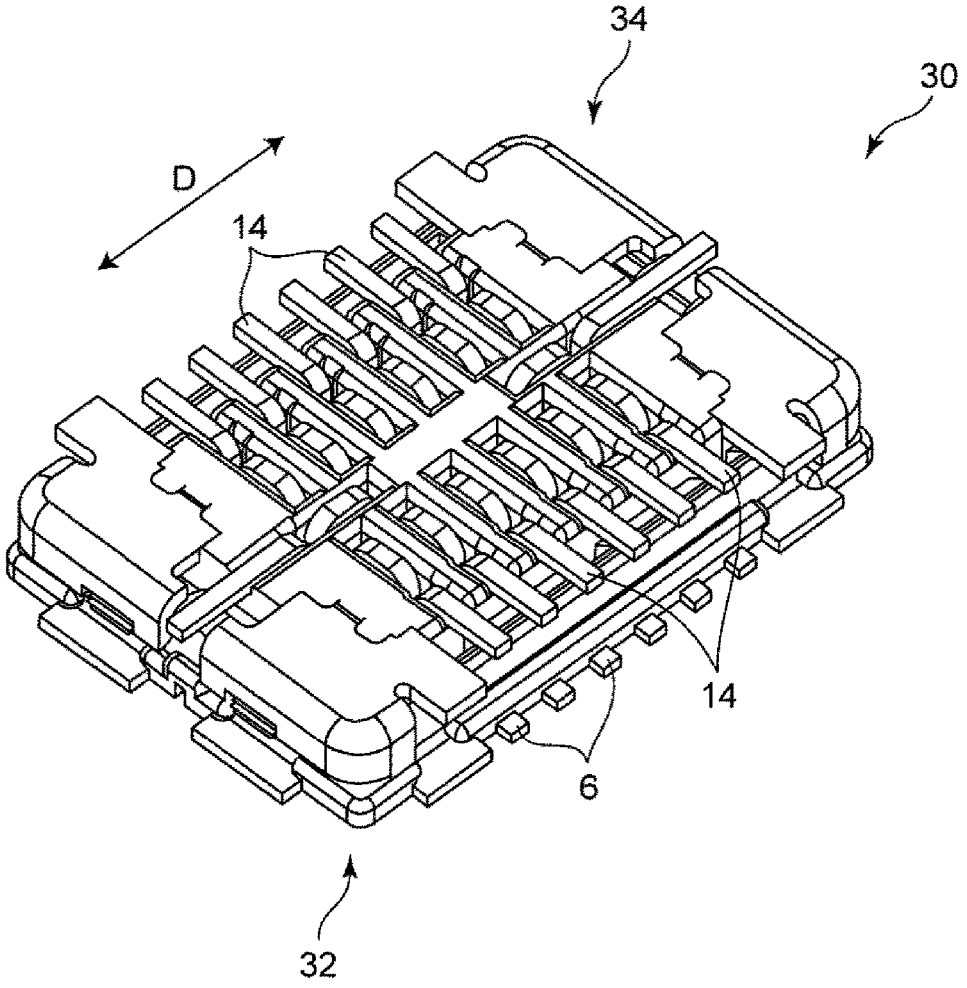
FIG. 7 is a perspective view of a multipolar connector set according to a second embodiment in a fitted state, as seen from a second connector side.
Figure 8:
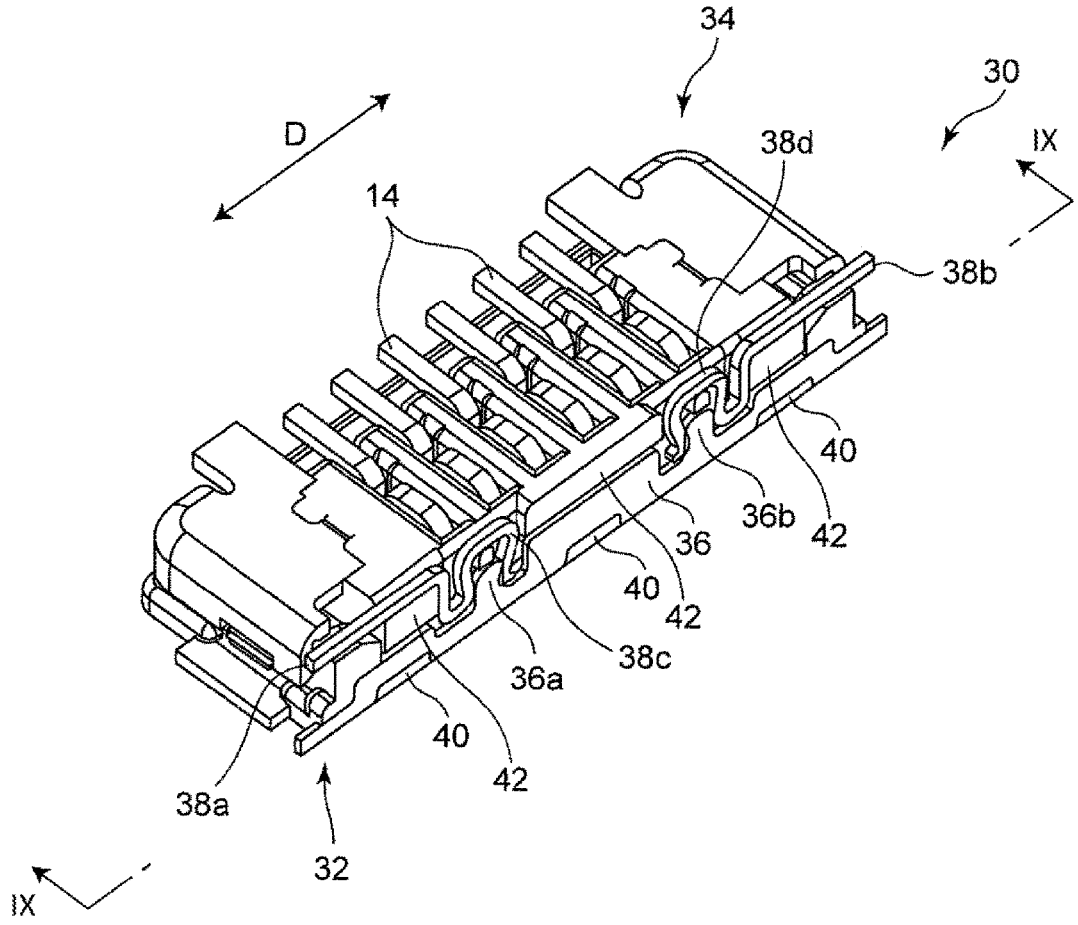
FIG. 8 is a cutaway perspective view of the multipolar connector set according to the second embodiment in the fitted state.
Figure 9:
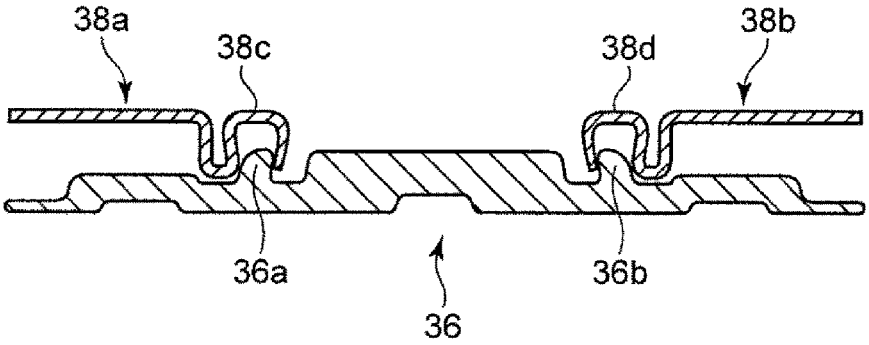
FIG. 9 illustrates part of a cross-section taken along line IX-IX of FIG. 8.

FIG. 7 is a perspective view illustrating a general configuration of a multipolar connector set 30 according to a second embodiment. FIG. 8 is a cutaway cross-sectional view of the multipolar connector set 30, and FIG. 9 is a cross-sectional view of the multipolar connector set 30 taken along line IX-IX of FIG. 8. To simplify the explanation, only shielding members 36, 38*a*, and 38*b* are shown in FIG. 9.

As illustrated in FIGS. 8 and 9, the multipolar connector set 30 of the second embodiment differs from the multipolar connector set 1 of the first embodiment in that the shielding member 36 and the shielding members 38*a* and 38*b* are in contact with each other, and that the shielding members 38*a* and 38*b* are two separate components.

As illustrated in FIGS. 7 and 8, the multipolar connector set 30 includes a first connector 32 and a second connector 34. The first connector 32 includes a shielding member 36 (see FIG. 8), and the second connector 34 includes the shielding members 38*a* and 38*b*. Components other than the shielding members 36, 38*a*, and 38*b* are similar to those of the first embodiment, and thus will not be described in detail.

As illustrated in FIG. 8, the shielding member 36 of the first connector 32 is a single, substantially plate-like shielding member. The shielding member 36 has two raised portions 36*a* and 36*b* which are protrusions to be fitted to the two shielding members 38*a* and 38*b*. The shielding member 36 is held by an insulating member 40 in such a manner to integrally support the two shielding members 38*a* and 38*b*.

Unlike the shielding member 36 having a substantially plate-like shape, the shielding members 38*a* and 38*b* of the second connector 34 are formed by bending substantially bar-like members into the same shape. The shielding members 38*a* and 38*b* are disposed to face each other along the direction D, and are held by an insulating member 42. The shielding members 38*a* and 38*b* have, at respective ends thereof, recessed portions 38*c* and 38*d* into which the raised portions 36*a* and 36*b* of the shielding member 36 are fitted.

In the second embodiment, the shielding members 38*a* and 38*b* of the same shape and material as the inner terminals 14 are used (see FIG. 2A). As in the first embodiment, the shielding members 36, 38*a*, and 38*b* are made of phosphor bronze, which is a conductive, elastically deformable material.

In the contact state illustrated in FIGS. 8 and 9, the shielding member 36 and the shielding members 38*a* and 38*b* are fitted together, with the raised portions 36*a* and 36*b* of the shielding member 36 inserted in the recessed portions 38*c* and 38*d* of the shielding members 38*a* and 38*b*. Since the recessed portions 38*c* and 38*d* and the raised portions 36*a* and 36*b* are elastically deformable members, inserting the raised portions 36*a* and 36*b* into the recessed portions 38*c* and 38*d*, respectively, expands the recessed portions 38*c* and 38*d* outward. In the fitted state illustrated in FIGS. 8 and 9, the outwardly expanded recessed portions 38*c* and 38*d* exert a biasing force that inwardly tightens the raised portions 36*a* and 36*b*. The biasing force thus allows the shielding member 36 and the shielding members 38*a* and 38*b* to be tightly fitted together.

In the multipolar connector set 30 of the second embodiment, as described above, the shielding member 36 and the shielding members 38*a* and 38*b* are in contact with each other in the fitted state. As compared to the configuration where the shielding members 12 and 20 are not in contact as in the first embodiment, this configuration more effectively suppresses electromagnetic wave interference between the rows of the inner terminals 6 and 14 and provides better shielding performance. The multipolar connector set 30 thus improves its signal transmission performance and improves its performance as a connector.

In the multipolar connector set 30 of the second embodiment, the shielding member 36 and the shielding members 38*a* and 38*b* are in contact at raised and recessed portions that are fitted together and made of an elastically deformable material. This configuration improves contact between the shielding member 36 and the shielding members 38*a* and 38*b*, and enhances a fit retaining force.

In the multipolar connector set 30 of the second embodiment, two shielding members 38*a* and 38*b* are disposed to face each other along the direction D in which the rows of the inner terminals 6 and 14 extend. The shielding member 36 is an integral member that holds the two shielding members 38*a* and 38*b*. With this configuration, where the shielding member 36 is in contact at two points with the shielding members 38*a* and 38*b*, one of the contacts will be kept even if the other is nearly released. This makes the first connector 32 and the second connector 34 less susceptible to disconnection. If the shielding members 38*a* and 38*b* are formed as a substantially plate-like integral member, a shielding effect against electromagnetic waves is further improved.

A shielding member formed in a substantially plate-like shape has better shielding performance against electromagnetic waves than that formed in a substantially bar-like shape, and more effectively suppresses electromagnetic wave interference between the rows of the inner terminals 6 and 14. On the other hand, a shielding member formed in a substantially bar-like shape is more elastically deformable than that formed in a substantially plate-like shape. In the second embodiment, where the shielding member 36 has a substantially "plate-like" shape and the other shielding members 38*a* and 38*b* have a substantially "bar-like" shape, it is possible both to suppress electromagnetic wave interference and to enhance the contact between the shielding member 36 and the shielding members 38*a* and 38*b*.

Third Embodiment

A multipolar connector set according to a third embodiment of the present disclosure will now be described with reference to FIGS. 10 to 16. The third embodiment mainly describes differences from the first and second embodiments. In the third embodiment, components that are the same as or similar to those of the first and second embodiments are denoted by the same reference numerals. In the third embodiment, descriptions overlapping those in the first and second embodiments are omitted.

Figure 10:
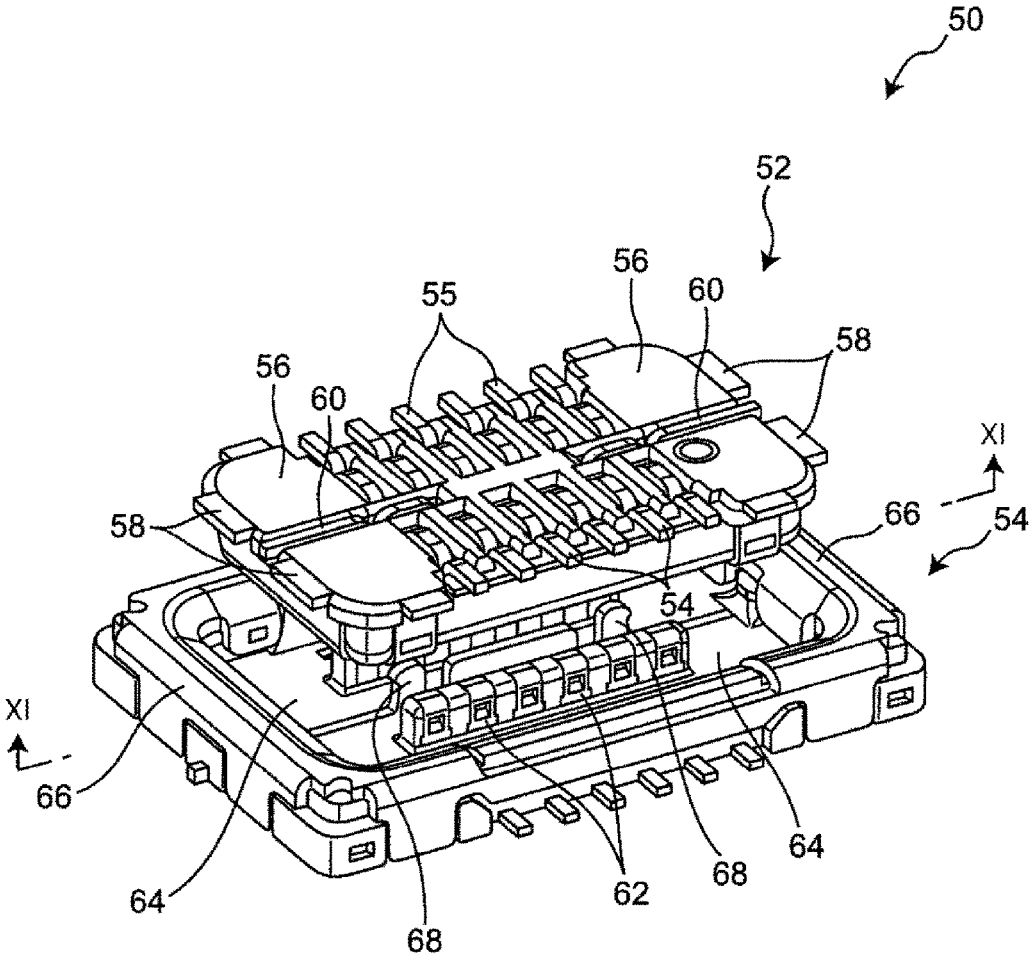
FIG. 10 is a perspective view of a multipolar connector set according to a third embodiment in a pre-fitted state.
Figure 11:
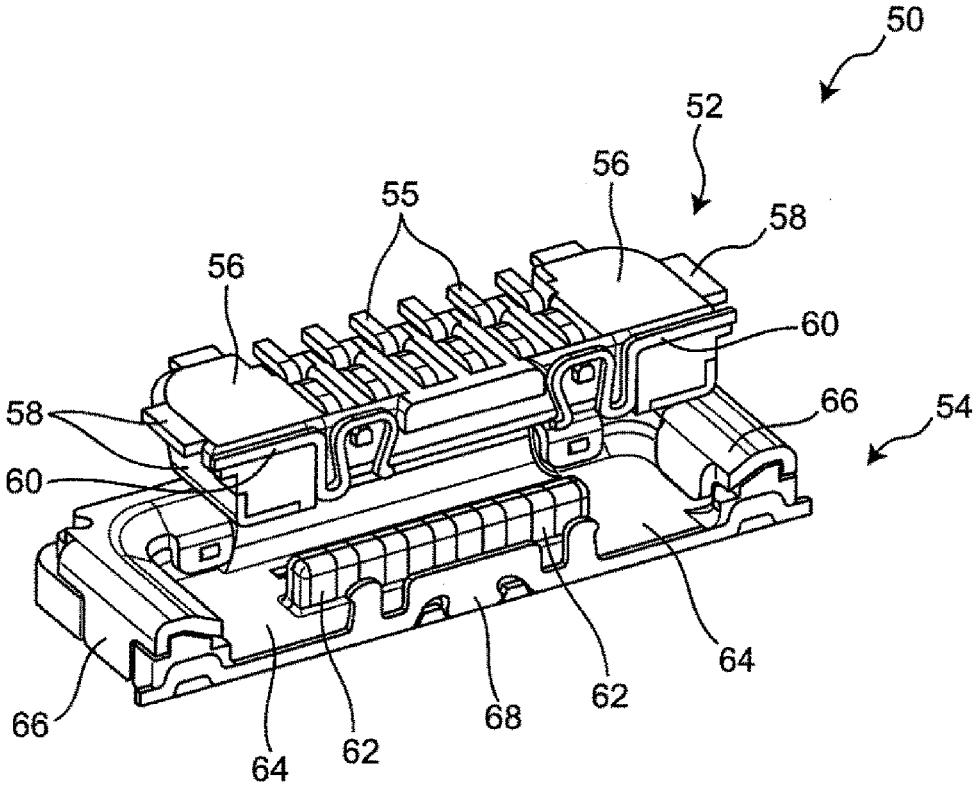
FIG. 11 is a perspective view of a cross-section of the multipolar connector set taken along line XI-XI of FIG. 10.
Figure 12:
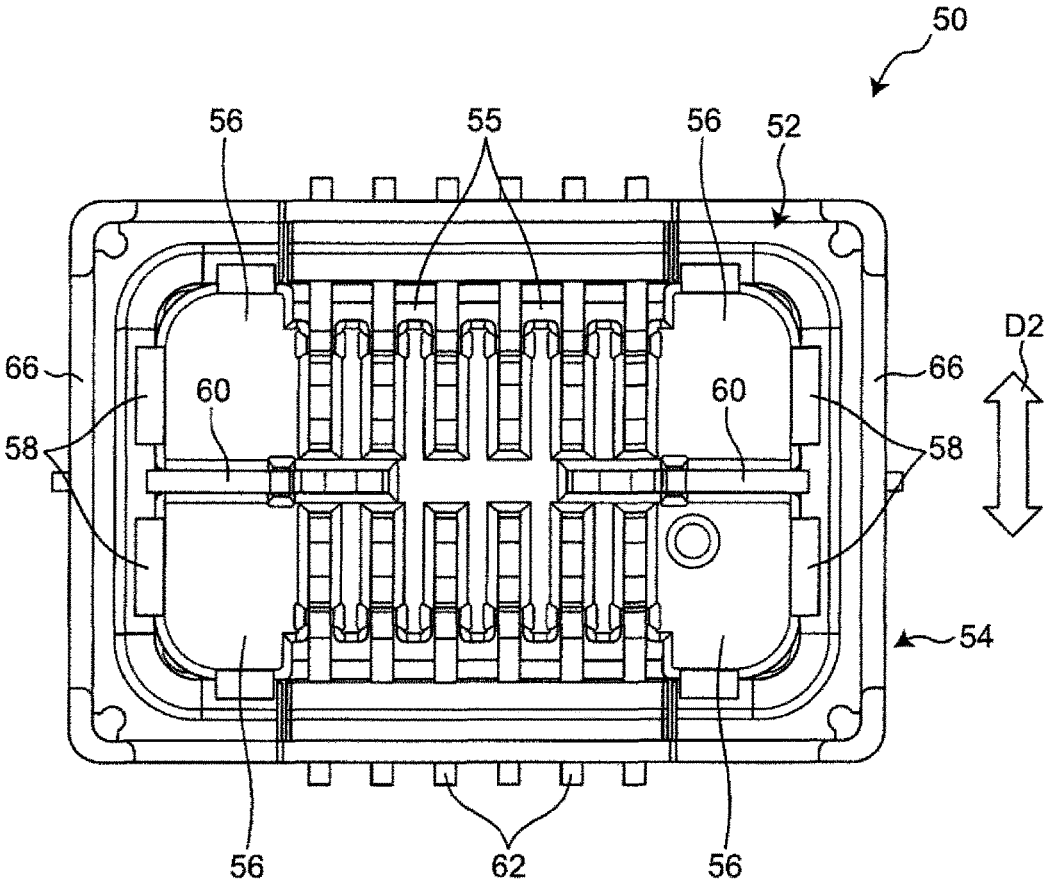
FIG. 12 is a plan view of the multipolar connector set according to the third embodiment.

A general configuration of a multipolar connector set 50 is described with reference to FIGS. 10 to 12. FIG. 10 is a perspective view of the multipolar connector set 50 according to the third embodiment in a pre-fitted state where connectors are not yet fitted together. FIG. 11 is a perspective view of a cross-section of the multipolar connector set 50 taken along line XI-XI of FIG. 10. FIG. 12 is a plan view of the multipolar connector set 50 in a fitted state where the connectors are fitted together. The multipolar connector set 50 of the third embodiment differs from the multipolar connector sets 1 and 30 of the first and second embodiments mainly in the shape of outer terminals.

As illustrated in FIGS. 10 to 12, the multipolar connector set 50 includes a first connector 52 and a second connector 54. The first connector 52 includes first inner terminals 55, a first insulating member 56, first outer terminals 58, and first shielding members 60. The second connector 54 includes second inner terminals 62, a second insulating member 64, a second outer terminal 66, and a second shielding member 68.

Figure 13:
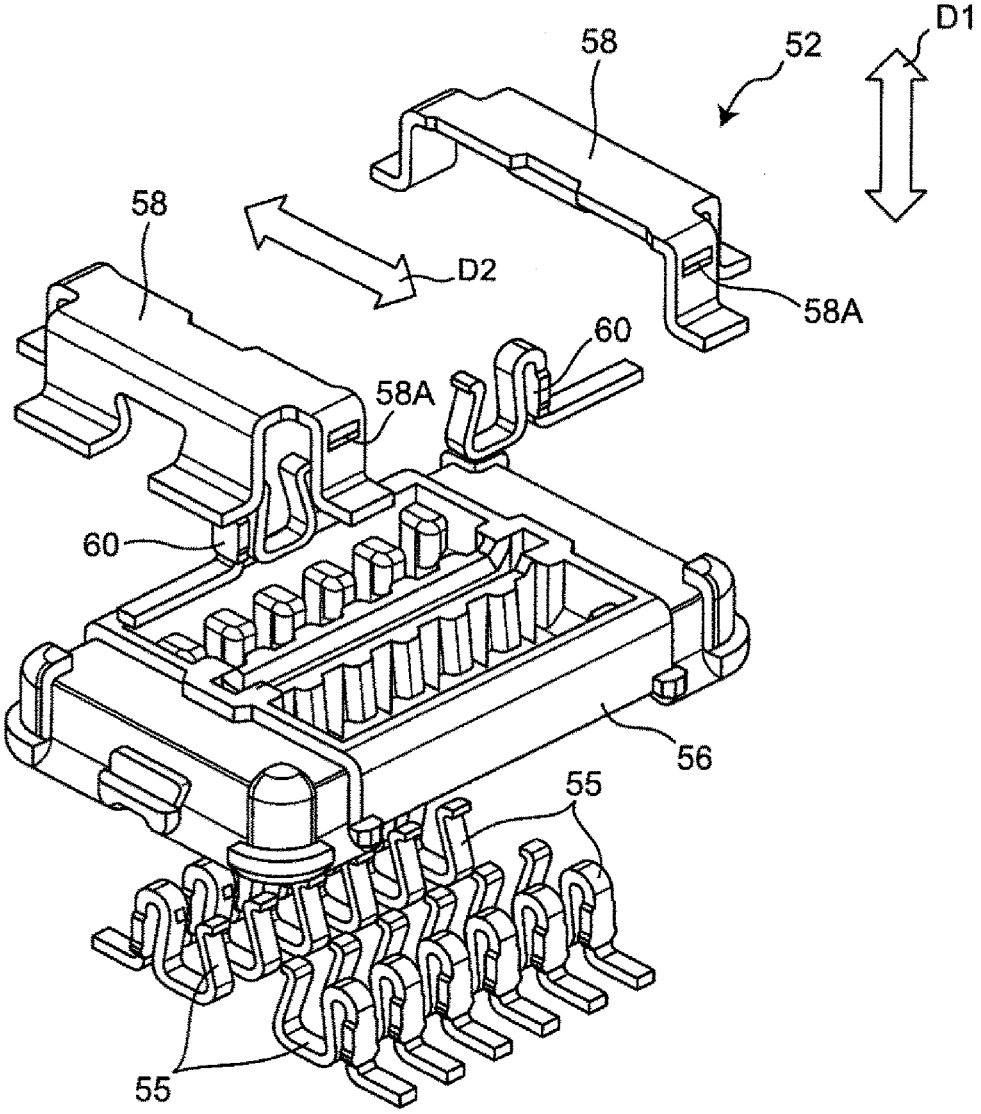
FIG. 13 is an exploded perspective view of a first connector according to the third embodiment.

FIG. 13 illustrates the first connector 52 in an exploded manner. Specifically, FIG. 13 is an exploded perspective view of the first connector 52 as seen from the opposite side of FIG. 10. As illustrated in FIG. 13, the first outer terminals 58 are disposed at about two positions opposite each other. The outer periphery of each first outer terminal 58 has a plurality of recesses 58A. Protrusions 66A (see FIG. 14) of the second outer terminal 66 of the second connector 54 (described below) are each fitted into a corresponding one of the recesses 58A. The recesses 58A are recessed in a direction (arrow D2) intersecting a direction (arrow D1) in which the first connector 52 and the second connector 54 face each other. In the present embodiment, the recesses 58A are provided at about four corners (only about two of the recesses 58A are shown in FIG. 13).

Figure 14:
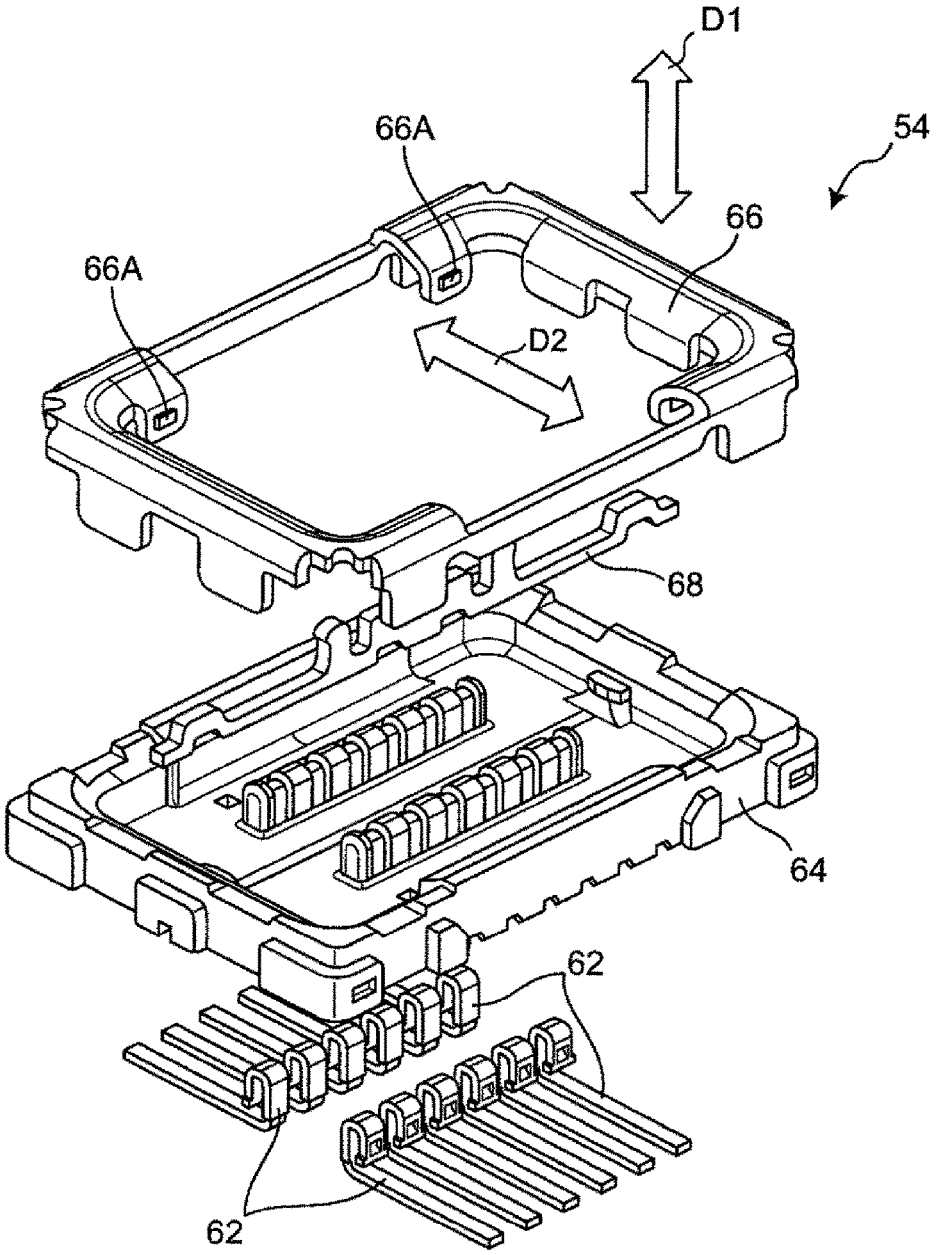
FIG. 14 is an exploded perspective view of a second connector according to the third embodiment.

FIG. 14 illustrates the second connector 54 in an exploded manner. Specifically, FIG. 14 is an exploded perspective view of the second connector 54 as seen from the same side as FIG. 10. Unlike the first outer terminals 58 described above, the second outer terminal 66 is provided as a single, substantially annular integral member as illustrated in FIG. 14. After the second connector 54 is assembled as in FIG. 10, the second outer terminal 66 is positioned to surround at least part of the second inner terminals 62 and the second shielding member 68. The second outer terminal 66 of a substantially annular shape thus has a better shielding effect against external noise or radiation noise, as compared to an outer terminal of a substantially non-annular, discontinuous shape.

As illustrated in FIG. 14, the inner peripheral of the second outer terminal 66 has a plurality of protrusions 66A. As described above, the protrusions 66A are each fitted into a corresponding one of the recesses 58A (see FIG. 13) of the first outer terminals 58 of the first connector 52. The protrusions 66A protrude in the direction (arrow D2) intersecting the direction (arrow D1) in which the first connector 52 and the second connector 54 face each other. In the present embodiment, the protrusions 66A are provided at about four corners (only about two of the protrusions 66A are shown in FIG. 14) to correspond to the respective recesses 58A.

In the fitted state illustrated in FIG. 12 and others, the protrusions 66A and the recesses 58A are engaged and fitted together in the direction (arrow D2) intersecting the direction in which the first connector 52 and the second connector 54 face each other. This relation makes the first connector 52 and the second connector 54 less susceptible to disconnection. Specifically, the first connector 52 and the second connector 54 become more resistant to a twisting removal force and more accurately maintain the fitted state.

Figure 15:
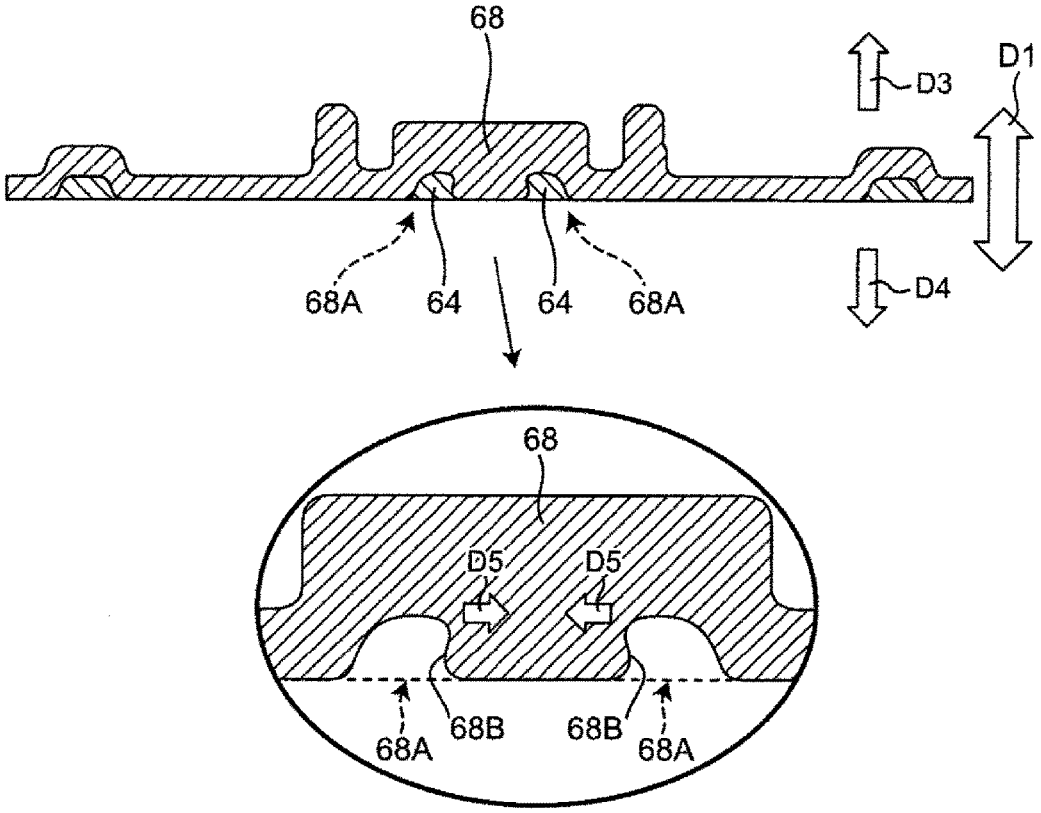
FIG. 15 illustrates a cross-sectional view of a second shielding member according to the third embodiment, and a magnified view of a central portion of the second shielding member.

FIG. 15 is a cross-sectional view of the second shielding member 68 of the second connector 54. As illustrated in FIG. 15, the second shielding member 68 has recesses 68A on a side (arrow D4) opposite a side (arrow D3) facing the first connector 52. In the present embodiment, the second shielding member 68 has about two recesses 68A that are symmetrical in shape.

The recesses 68A are filled with the second insulating member 64. The recesses 68A are shaped to allow the second insulating member 64 therein to be caught in the second shielding member 68. This prevents the second shielding member 68 from falling off. Specifically, as illustrated in an enlarged view in FIG. 15, an inside face 68B of the second shielding member 68 defining each recess 68A is recessed in a direction in which the recess 68A is expanded (arrow D5). With the inside faces 68B of this shape, the second insulating member 64 is caught in the second shielding member 68 to prevent the second shielding member 68 from falling off.

Figure 16:
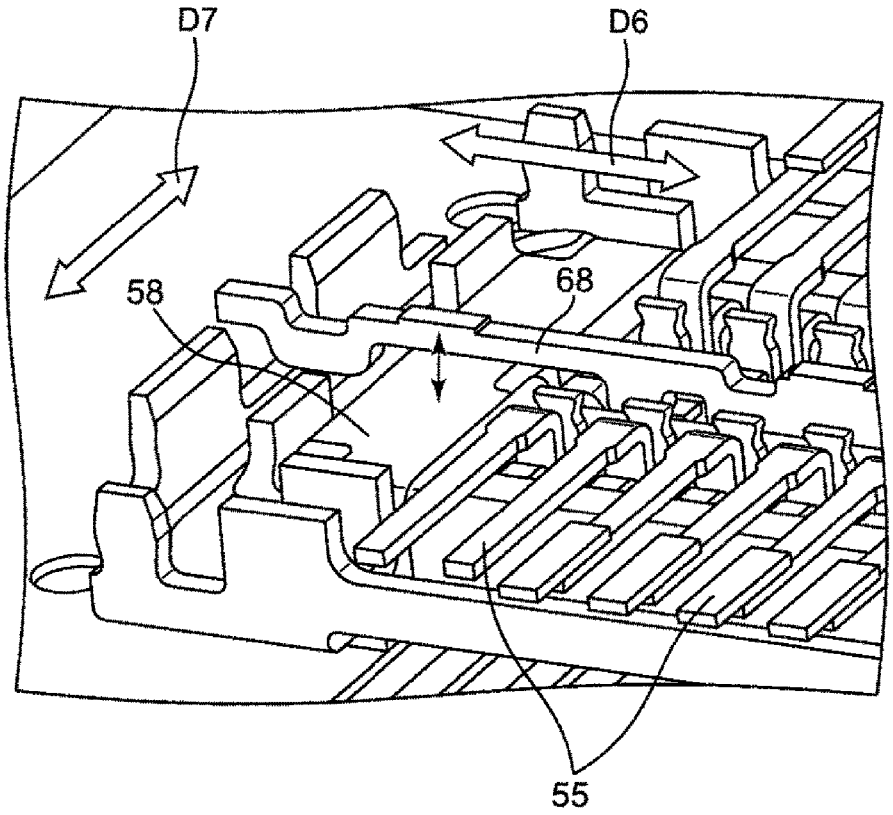
FIG. 16 is a perspective view for explaining a contact between the second shielding member and first outer terminals according to the third embodiment.

In the fitted state illustrated in FIG. 12 and others, the second shielding member 68 is in contact with the first outer terminals 58 of the first connector 52. Specifically, as illustrated in FIG. 16, the first outer terminals 58 have a length that passes across the second shielding member 68 in a direction (arrow D7) intersecting a direction (arrow D6) in which the second shielding member 68 extends. Thus, in the fitted state, the second shielding member 68 is in contact with the first outer terminals 58. By bringing the second shielding member 68 into contact with the first outer terminals 58, electromagnetic wave interference between the rows of the inner terminals is further suppressed.

In the multipolar connector set 50 of the third embodiment, as in the multipolar connector sets 1 and 30 of the first and second embodiments, the first connector 52 includes the first outer terminals 58 and the first shielding members 60, and the second connector 54 includes the second outer terminal 66 and the second shielding member 68. Thus, with the first connector 52 and the second connector 54 including the outer terminals 58 and 66 and the shielding members 60 and 68, a higher degree of design freedom is achieved than in the case of including only one outer terminal or one shielding member.

Although the present disclosure has been described with reference to the first to third embodiments, the present disclosure is not limited to the first to third embodiments described above. For example, although the first connector 2 (32) and the second connector 4 (34) include the outer terminals 10 and 18, respectively, in the first and second embodiments, the present disclosure is not limited to this. Even without the outer terminals 10 and 18, the shielding members suppress interference between the rows of the inner terminals 6 and 14. With the outer terminals 10 and 18, the capability of the multipolar connector sets 1 and 30 is further improved, as radio wave interference with the inner terminals 6 and 14 from outside the connectors is reduced.

Although the multipolar connector set 1 of the first embodiment includes two shielding members 12 and 20, the present disclosure is not limited to this. For example, only one of the connectors may include a substantially plate-like shielding member, which is fitted into a groove of the other connector. Even with this structure, the shielding member suppresses electromagnetic wave interference between the rows of the inner terminals 6 and 14. With about two or more shielding members, it is possible to reduce the sizes of individual shielding members and facilitate handling of connectors.

In the first embodiment described above, the insulating member 8 of the first connector 2 has, on the board mounting side thereof, the grooves 13 around the region where the shielding member 12 is exposed. However, the present disclosure is not limited to this. The insulating member 16 of the second connector 4 may have, on the board mounting side thereof, similar grooves around a region where the shielding member 20 is exposed. When the second connector 4 is soldered to the circuit board, this configuration prevents the inner terminals 14 and the shielding member 20 from being connected by the solder and reduces entry of the solder into the interior of the connector.

Although the inner terminals 6 and 14 are both arranged in about two rows in the first and second embodiments described above, the present disclosure is not limited to this, and they may be arranged in about three or more rows. The shielding members may be arranged in multiple rows, as the number of rows of the inner terminals 6 and 14 increases.

Although the inner terminals 6 and 14, the outer terminals 10 and 18, and the shielding members 12 and 20 (38*a* and 38*b*, 36) are all made of the same material (phosphor bronze) in the first and second embodiments described above, the present disclosure is not limited to this, and they may be made of different conductive materials. Although phosphor bronze is used as a material in the first and second embodiments described above, the present disclosure is not limited to this, and any other conductive material may be used. For example, by using a Corson alloy instead of phosphor bronze, the conductivity of the inner terminals 6 and 14 is particularly improved. The surfaces of the components described above may be plated with gold.

In the second embodiment described above, the shielding members 36, 38*a*, and 38*b* are all made of an elastically deformable material (phosphor bronze), so that the shielding member 36 and the shielding members 38*a* and 38*b* are fitted together. However, the present disclosure is not limited to this, and it is only necessary that at least the shielding member 36 or the shielding members 38*a* and 38*b* be made of an elastically deformable material. Besides phosphor bronze, any material may be used as long as it is elastically deformable.

Although the shielding members 38*a* and 38*b* of the second connector 34 are of the same shape and material as the inner terminals 14 in the second embodiment described above, the present disclosure is not limited to this. The shielding members 38*a* and 38*b* may be of a shape different from that of the inner terminals 14, as long as they can contact and be fitted to the opposite shielding member 36.

Although the second shielding member 68 of the second connector 54 and the first outer terminals 58 of the first connector 52 are in contact in the third embodiment described above, the present disclosure is not limited to this. The first shielding members 60 of the first connector 52 and the second outer terminal 66 of the second connector 54 may be in contact. Even with this configuration, the first shielding members 60 further suppress electromagnetic wave interference between the rows of the inner terminals.

Although the second outer terminal 66 of the second connector 54 is of a substantially annular shape in the third embodiment described above, the present disclosure is not limited to this. For example, the first outer terminals 58 of the first connector 52 may be formed in a substantially annular shape to surround at least part of the first inner terminals 55 and the first shielding members 60 of the first connector 52. Even with this configuration, the shielding effect against external noise or radiation noise is improved.

In the third embodiment described above, the second shielding member 68 has the recesses 68A, which are filled with the second insulating member 64 and shaped to allow the second insulating member 64 to be caught in the second shielding member 68. However, the present disclosure is not limited to this. For example, the first shielding members 60 of the first connector 52 may have recesses on a side opposite a side facing the second connector 54. In this case, the recesses of the first shielding members 60 are filled with the first insulating member 56, which is caught in the first shielding members 60. This configuration prevents the first shielding members 60 from falling off.

In the third embodiment described above, the second outer terminal 66 has the protrusions 66A, and the first outer terminals 58 has the recesses 58A in which the respective protrusions 66A are engaged in the fitted state. However, the present disclosure is not limited to this. For example, the first outer terminals 58 may have protrusions and the second outer terminal 66 may have recesses for accommodating the protrusions, so that the protrusions and the recesses are engaged in the fitted state. Even with this configuration, the connectors are made less susceptible to disconnection.

The present disclosure is applicable to any multipolar connector sets formed by fitting a first connector and a second connector together.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multipolar connector set comprising:

a first connector including first inner terminals arranged in multiple rows and a first insulating member configured to hold the first inner terminals;

a second connector, fitted to the first connector, and including second inner terminals arranged in multiple rows and a second insulating member configured to hold the second inner terminals;

a conductive shielding member disposed between adjacent rows of the first or second inner terminals in a fitted state where the first connector and the second connector are fitted together, with the first inner terminals being in contact with the second inner terminals;

wherein the shielding member includes a first shielding member held by the first insulating member of the first connector, and a second shielding member held by the second insulating member of the second connector;

the first shielding member and the second shielding member are in contact with each other at recessed and raised portions thereof that are fitted together; and the raised portion has a length that is smaller than a depth of the recessed portion.

2. The multipolar connector set according to claim 1, wherein:

at least one of the first connector and the second connector further includes an outer terminal connected to a ground potential and held by a corresponding one of the first insulating member and the second insulating member; and the shielding member is electrically connected to the outer terminal.

3. The multipolar connector set according to claim 1, wherein the recessed and raised portions being at least partly made of an elastically deformable material.

* * * * *